US010500430B2

(12) United States Patent
Ismail

(10) Patent No.: US 10,500,430 B2
(45) Date of Patent: Dec. 10, 2019

(54) PORTABLE EXERCISE APPARATUS

(71) Applicant: Said Abdow Ismail, Scarborough (CA)

(72) Inventor: Said Abdow Ismail, Scarborough (CA)

( * ) Notice: Subject to any disclaimer, the term of this patent is extended or adjusted under 35 U.S.C. 154(b) by 99 days.

(21) Appl. No.: 15/821,734

(22) Filed: Nov. 22, 2017

(65) Prior Publication Data

US 2018/0117381 A1 May 3, 2018

Related U.S. Application Data

(63) Continuation of application No. 11/896,140, filed on Aug. 30, 2007, now Pat. No. 9,855,454.

(51) Int. Cl.

| | |
|---|---|
| ***A63B 21/00*** | (2006.01) |
| ***A63B 21/055*** | (2006.01) |
| ***A63B 23/12*** | (2006.01) |
| ***A63B 21/062*** | (2006.01) |
| ***A63B 23/035*** | (2006.01) |
| ***A63B 21/04*** | (2006.01) |
| ***A63B 23/02*** | (2006.01) |

(52) U.S. Cl.

CPC .... *A63B 21/00043* (2013.01); *A63B 21/0004* (2013.01); *A63B 21/0552* (2013.01); *A63B 21/0628* (2015.10); *A63B 21/154* (2013.01); *A63B 21/4007* (2015.10); *A63B 21/4009* (2015.10); *A63B 21/4025* (2015.10); *A63B 23/03541* (2013.01); *A63B 23/12* (2013.01); *A63B 23/1209* (2013.01); *A63B 21/0442* (2013.01); *A63B 21/0557* (2013.01); *A63B 21/4035* (2015.10); *A63B 23/0211* (2013.01); *A63B 23/0233* (2013.01); *A63B 23/03533* (2013.01); *A63B 2210/50* (2013.01)

(58) Field of Classification Search

CPC ..... A63B 21/0552
USPC ..... 482/124
See application file for complete search history.

(56) References Cited

U.S. PATENT DOCUMENTS

| | | | | |
|---|---|---|---|---|
| 5,518,480 A * | 5/1996 | Frappier | A63B 21/0004 | 482/124 |
| 5,916,070 A * | 6/1999 | Donohue | A63B 21/151 | 482/114 |
| 6,659,921 B2 * | 12/2003 | Vernon | A63B 21/0442 | 482/114 |
| 6,691,318 B1 * | 2/2004 | Davis | A63B 21/0004 | 2/102 |
| 7,934,267 B2 * | 5/2011 | Nordstrom | A41D 13/0015 | 2/69 |
| 8,702,430 B2 * | 4/2014 | Dibenedetto | G16H 40/67 | 434/247 |

* cited by examiner

*Primary Examiner* — Lori L Baker
(74) *Attorney, Agent, or Firm* — Aird & McBurney LP

(57) ABSTRACT

An exercise apparatus comprising: a jacket member comprising a front portion and a back portion; at least one protuberance member disposed on at least one of the front portion and the back portion; at least one resistance cable having one end removably attached to the at least one protuberance member via the aperture and another end having a grip handle member; and at least one arm brace removably attached to the jacket member.

20 Claims, 13 Drawing Sheets

1060

PORTABLE EXERCISE APPARATUS

CROSS-REFERENCE TO RELATED APPLICATIONS

This application is a continuation-in-part of U.S. patent application Ser. No. 11/896,140, filed on Aug. 30, 2007.

FIELD OF THE INVENTION

The present invention relates generally to an apparatus for performing upper body exercises and more particularly, to a portable exercise apparatus ideal for both indoor and outdoor use which includes a jacket with shoulder/chest harness, interchangeable resistance cables and a set of grip handles in order to perform a variety of exercises.

DESCRIPTION OF THE RELATED ART

Nowadays, the public is cognizant of the connection between physical exercise and good health. As such, stationary exercise equipment, as well as certain portable ones is prevalent in gymnasiums, schools and individual homes. In addition, physicians and other medical personnel advise the public to be aware of the advantages of proper diet and exercise in maintaining a healthy lifestyle. With the public being informed of health matters, an increasing number of people closely monitor their diet and participate in some form of physical exercise in order to maintain good health and increase their chances of living a longer healthy life. The myriad of exercise equipment available to the public includes cable machines for weight training or functional training.

Functional training has been developed by physical therapists, imitating physical activities of daily life. It involves mainly weight-bearing activities targeted at core muscles of the upper torso, and is geared towards better muscular balance and joint stability in order to get better performance of any activity, and to lessen the occurrence of injuries. In comparison, weight training targets to isolate particular muscles, i.e. biceps, triceps, abdominal muscles etc., functional training can be accomplished using a number of different exercise motions using either free weights, such as dumbbells and barbells, or using cable machines to facilitate the various exercise motions.

A cable machine is an item of equipment used in weight training or functional training. FIG. 1 is an illustration of a cable machine. Given its size, the cable machine may only be placed in a gymnasium or in a home with enough space. As shown in FIG. 1, the machine consists of a rectangular, vertically-oriented steel frame 110, which is about 10 feet wide and 7 feet high, with a weight stack at each end 120. A pair of cables 130 is connected to handles 140 to the weight stacks run through a number of adjustable pulleys 150 that may be fixed at any height. This allows a variety of exercises to be performed on the apparatus. Attached on either end of the cable is a perforated steel plate that runs down the center of the weight stack, in order to allow the user to the select the desired amount of resistance. Most cable machines have a minimum of 20 pounds of resistance in order to counter-balance the weight of a typical attachment. As can be seen from FIG. 1, such a machine is typically stationary and can only be placed indoors in a large enough room.

Unfortunately, there are no alternatives to the cable machines in existence today when it comes to complete functional training equipment. In addition, portability of such exercise equipment is almost non-existent.

Furthermore, shoulder pain is the third most common cause of musculo-skeletal consultation in North America. The self-reported incidence of shoulder pain in the general population is between 16-26%. Out of the multiple types of shoulder injuries, the most prevalent is by far is subacromial impingement. This happens when the rotator cuff tendons become irritated and/or inflamed as they pass through the subacromial space, the area between the acromion (a bony spike/guide extruding out from the scapula). The most common demographic and causes of shoulder injuries are: ages 35-75 (advancing age); overhead motions and lifting; wear and tear (overuse e.g. sports); and sudden injury (accidents). The most common preventative measures and treatments include: limiting and reducing aggravating movements; physiotherapy, shoulder slings and braces, and steroidal injections at the site of the injury. However, the preventative measures are not always adhered to and the treatments may be inconvenient and costly. While steroidal injections assist with healing they do not substantially prevent further injury in a weak shoulder.

At present, there is a shortage of suitable exercise equipment that is portable, and can be used in both outdoors and indoors. It would be advantageous to have an exercise equipment that combines as many exercises into a single exercise machine. Therefore, a need exists for an exercise machine that allows an exerciser to perform a number of upper torso exercises in both indoors and outdoors. In addition, for such an exercise machine, it will be advantageous for it to be portable as well as light weight. It is also desirable for such an exercise machine to be a low cost machine, while still maintaining the advantages and feel of traditional exercise motions, such as the bench press, the dumbbell press, and the dumbbell fly, with the added safety of performing such exercises on an exercise machine.

It is an object of the present invention to mitigate or obviate at least one of the above-mentioned disadvantages.

SUMMARY OF THE INVENTION

In one of its aspects, there is provided an exercise apparatus comprising:

a jacket member comprising a front portion and a back portion;

at least one protuberance member disposed on at least one of the front portion and the back portion;

at least one resistance cable having one end removably attached to the at least one protuberance member via the aperture and another end having a grip handle member;

at least one arm brace removably attached to the jacket member.

In another of its aspects, there is provided an exercise apparatus comprising:

a jacket member comprising a front portion and a back portion;

at least one exercise logging device comprising at least one protuberance member with an aperture; the at least one protuberance member disposed on at least one of the front portion and the back portion;

at least one resistance cable having one end removably attached to the at least one protuberance member via the aperture and another end having a grip handle member;

sensing elements associated with electronic circuitry for detecting forces applied to the at least one protuberance member by the at least one resistance cable.

In yet another of its aspects, there is provided a method for tracking exercises, the method comprising:

providing an exercise apparatus comprising:

a jacket member comprising a front portion and a back portion;

at least one exercise logging device comprising at least one protuberance member with an aperture; the at least one protuberance member disposed on at least one of the front portion and the back portion;

at least one resistance cable having one end removably attached to the at least one protuberance member via the aperture and another end having a grip handle member;

sensing elements associated with electronic circuitry for detecting forces applied to the at least one protuberance member by the at least one resistance cable;

providing a computer readable medium for storing data pertaining to the detected forces;

providing a processor, the computer readable medium further comprising instructions executable by the processor at least to:

track the exercises;

determine adherence to a predetermined exercise regimen;

generate a report associated with the exercises and predetermined exercise regimen.

Advantageously, the present invention provides a portable multi-exercise gym apparatus, small enough and light enough for indoor as well as outdoor activities. The upper-body exercise apparatus can be used for both recovery and preventative strengthening. Furthermore, the upper-body exercise apparatus provides ways to safely and methodically perform focused strengthening exercises through the use of resistance bands, and can be incredibly beneficial for patients who wish to regain shoulder strength and mobility, as well as minimize the risk of future shoulder injuries.

BRIEF DESCRIPTION OF THE DRAWINGS

Several exemplary embodiments of the present invention will now be described, by way of example only, with reference to the appended drawings in which.

DESCRIPTION OF EXEMPLARY EMBODIMENTS

The detailed description of exemplary embodiments of the invention herein makes reference to the accompanying block diagrams and schematic diagrams, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Moreover, it should be appreciated that the particular implementations shown and described herein are illustrative of the invention and its best mode and are not intended to otherwise limit the scope of the present invention in any way. Connecting lines shown in the various figures contained herein are intended to represent exemplary functional relationships and/or physical couplings between the various elements. It should be noted that many alternative or additional functional relationships or physical connections may be present in a practical system.

The jacket of the present invention is constructed from readily available materials. Preferably, the material may be chosen from a light fabric, such as, for example, nylon with a hyper plush, and smooth-skin. In order to minimize friction due to the back-and-forth movement of the nature of the exercises performed by users, the jacket material will be coated with a low surface friction coating, such as a super composite skin, a material available in the market.

Figure 1:
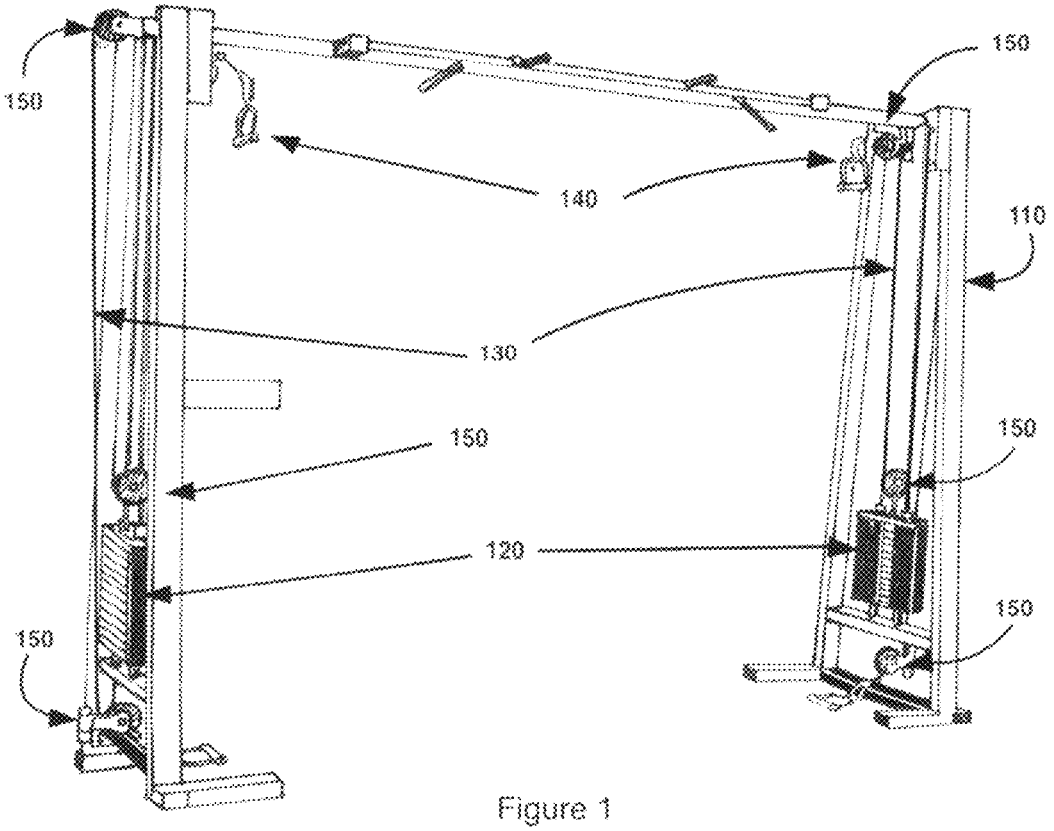
FIG. 1 is a prior art of illustration of a cable machine normally found in gymnasiums.
Figure 2:
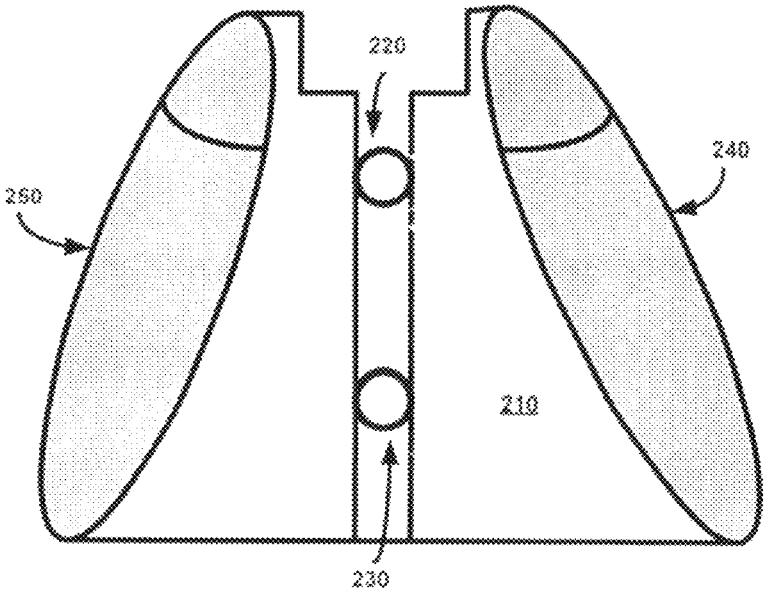
FIG. 2 is a frontal view of the jacket, in one embodiment.
Figure 3:
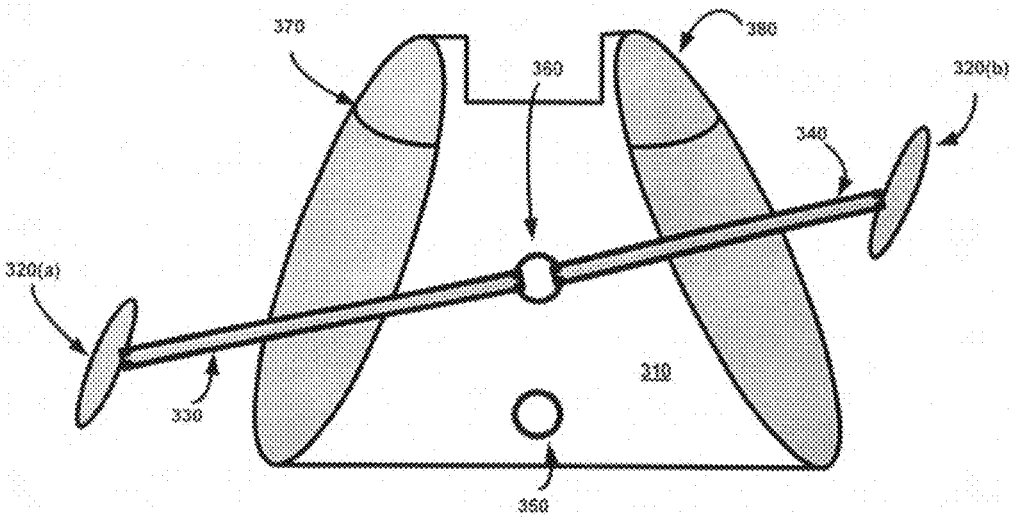
FIG. 3 is a rear view of the jacket of FIG. 2.
Figure 4:
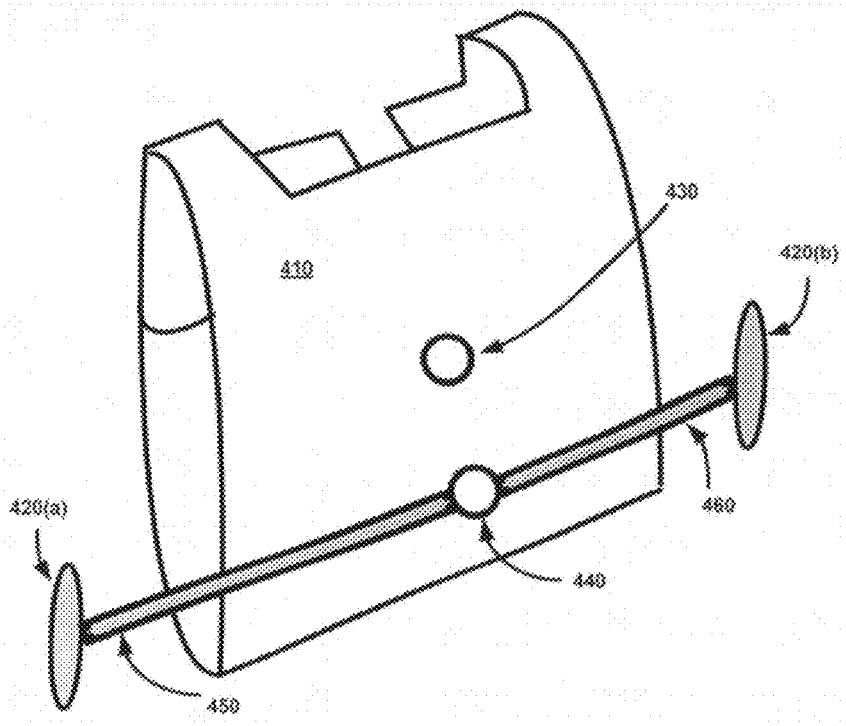
FIG. 4 is a back-side view of a jacket with the resistance cables according to another embodiment.
Figure 5:
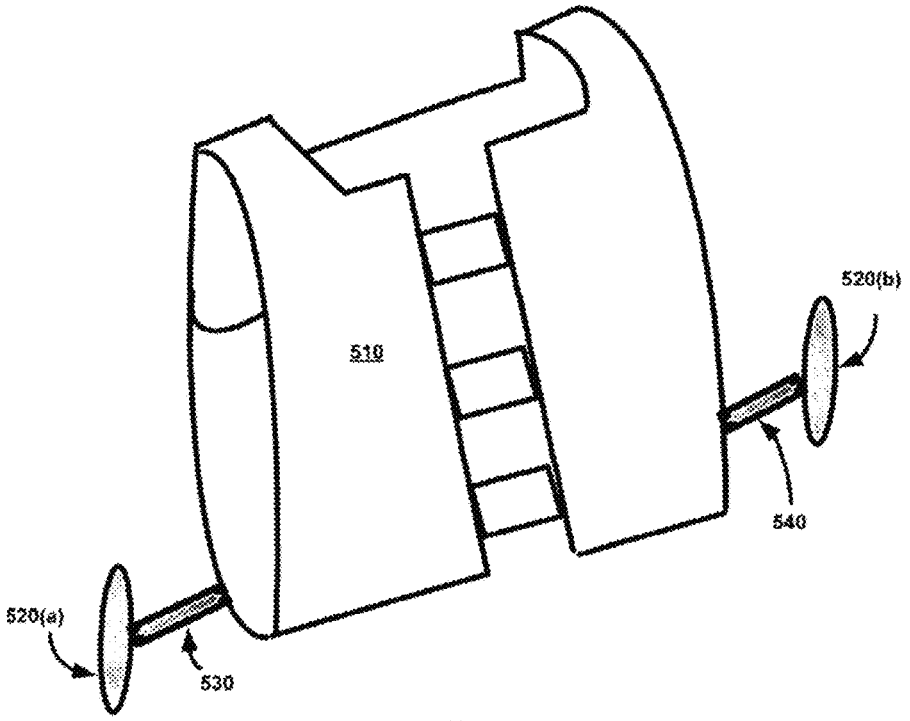
FIG. 5 is a front-side view of the jacket of FIG. 4 with resistance cables.
Figure 6:
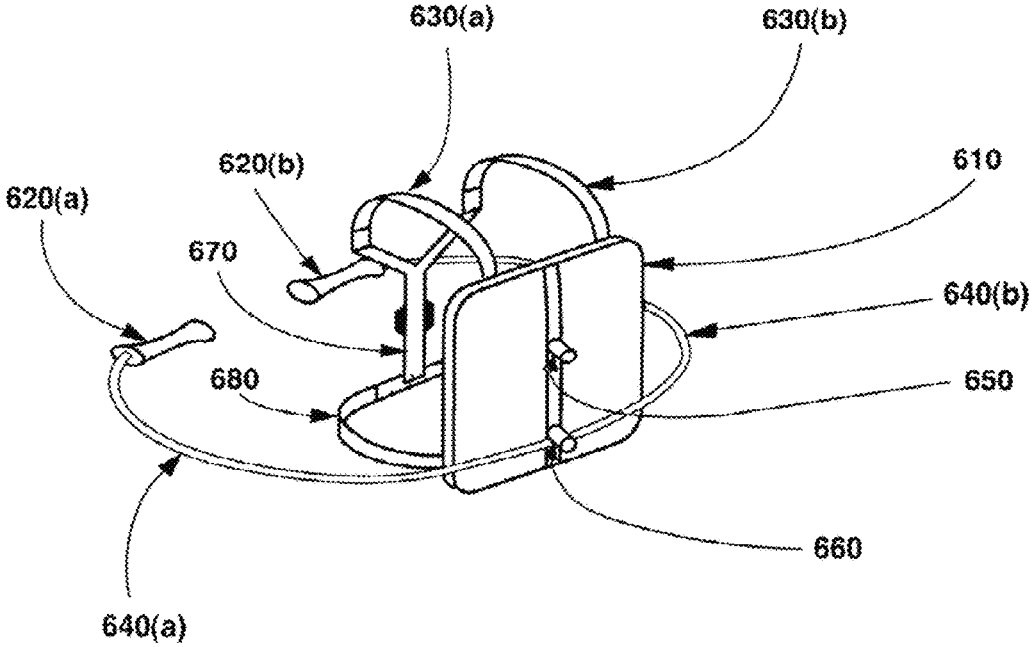
FIG. 6 is a back-side view of a jacket with resistance cables and a shoulder/chest harness according to another embodiment.

With reference now to the drawings, and in particular to FIGS. 2 to 6 thereof, a novel and improved exercise apparatus embodying the principles and concepts of the present invention is referred to generally in FIG. 6 by the reference numeral 600. It should be understood that exercise apparatus 600 may be used to perform many different types of exercises including cardiovascular fitness and, therefore, should not be limited to muscle toning. Through a non-limiting example, a boxer who may be training for an upcoming bout, normally trains by running to increase his/her endurance, and spars in the ring to hone his/her punching skills. By using the exercise apparatus of the current invention, such a boxer may be able to attain both of those skills.

In particular, in one implementation the portable exercise apparatus 600 comprises a jacket 610 that can be worn on the user's upper body, having an upper protuberance member 650 and a lower protuberance member 660, each with an aperture for engaging a pair of resistance cables 640(*a*) and

640(*b*) that are respectively connected to a pair of grip handles 620(*a*) and 620(*b*). Preferably, in the event a user desires to exercise certain muscle groups such as arm muscles, triceps, deltoids and upper chest muscles, the user engages resistance cables 640(*a*) and 640(*b*) in the lower protuberance member 660. Similarly, for exercising biceps and lower chest muscles, a user engages resistance cables 640(*a*) and 640(*b*) in the upper protuberance member 650.

Figure 7A:
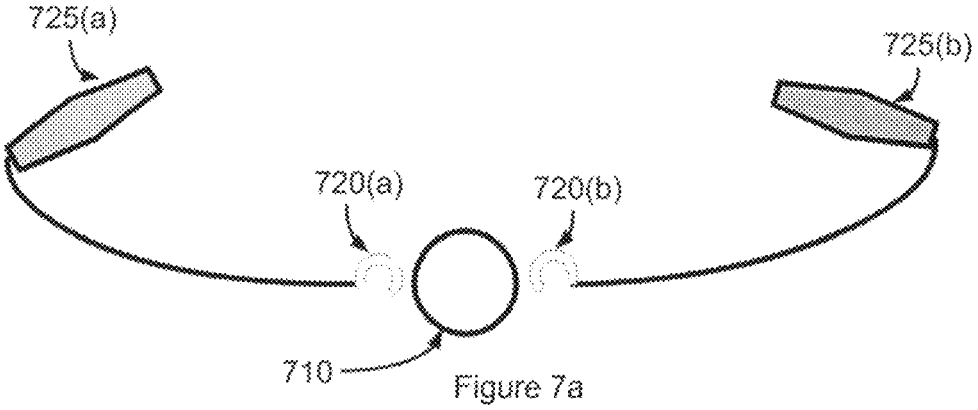
FIGS. 7*a* and 7*b* show a jacket protuberance member in connection to the resistance cables.
Figure 7B:
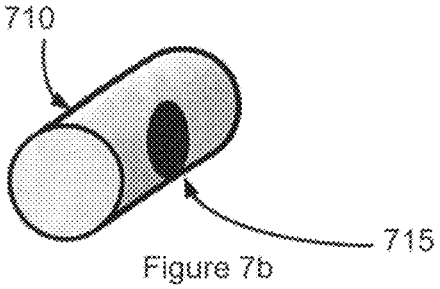

In operation, and as shown in FIGS. 6 and 7, a user (not shown) connects resistance cables 730(*a*) and (*b*) by placing resistance cable hook 720(*a*) and (*b*) through aperture 715 of either one of the upper or lower protuberance members, which for simplicity is marked 710. After resistance cable hooks 720(*a*) and (*b*) are secured together, the user puts on jacket 610 like a normal vest, and then shoulder straps 630(*a*) and (*b*), chest strap 670 and mid-section strap 680 are adjusted per the user's fit and comfort level.

Figure 8:
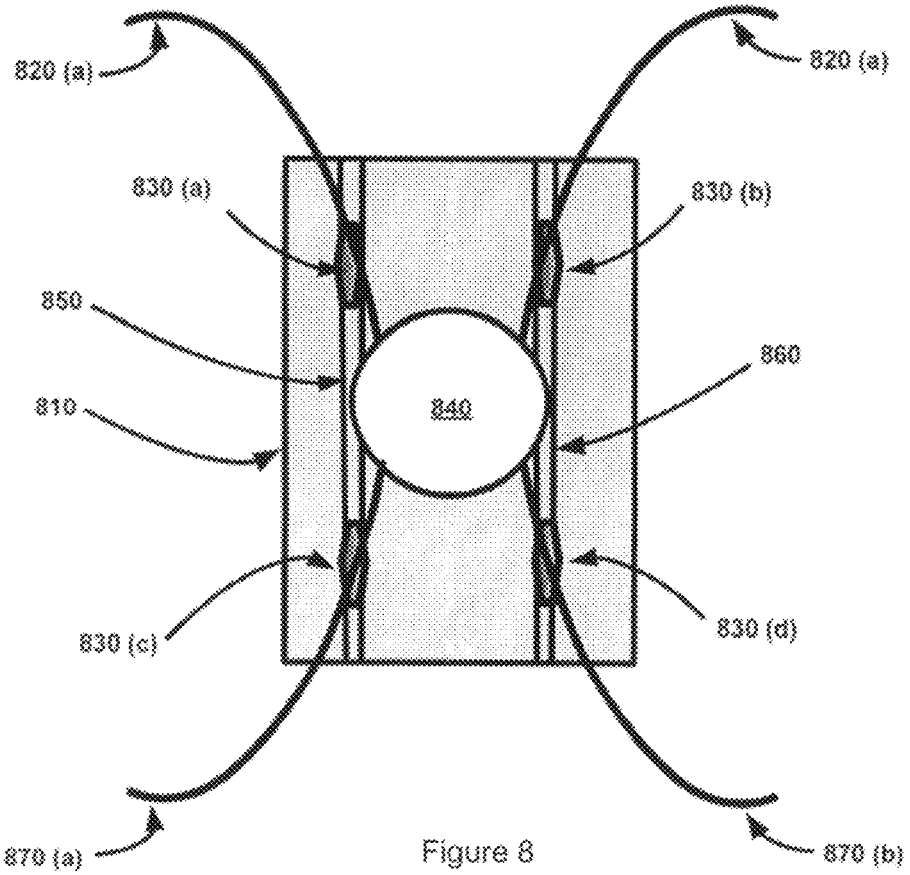
FIG. 8 is a back-side view of the jacket illustrating ways of adjusting the resistance cables to two different positions.

In another implementation, and in reference to FIG. 8, there is shown means for adjusting the resistance cables (not shown) without taking off the jacket and removing the cables from one position to attach it to another position. Jacket 810 includes two track-like members 850 and 860 with upper depressions 830(*a*) and 830(*b*) and lower depressions 830(*c*) and 830(*d*). A single protuberance member 840 where the resistance cables (not shown) are secured therein, slides up and down track members 850 and 860 by pulling cords 820(*a*) and 820(*b*) that go over the shoulders of the user, and which are secured on the front side of jacket 810 by comprise an fastening means such as a hook and loop locking mechanism e.g. VELCRO™, and settles in the upper depressions 830(*a*) and 830(*b*), allowing the user to engage in a set of exercise movement for certain muscles such as abdominals, shoulder muscles, deltoids, upper chest muscles and triceps. In the event that the user desires to exercise another group of muscles such as, biceps, lower chest muscles, triceps and front/back deltoids, the user pulls on cords 870(*a*) and 870(*b*) that go on the side of the user, and which are identically secured on the front side of jacket 810 by VELCRO allowing protuberance member 840 to settle in the lower depressions 830(*c*) and 830(*d*) without the user pausing to unhook the resistance cables.

FIGS. 2 to 5 are included in order to illustrate different perspectives of the jacket to further depict the jacket in conjunction with the resistance cables. It should be noted that multiple resistance cables may be employed by a user depending on the desired resistance workout.

Figure 9A:
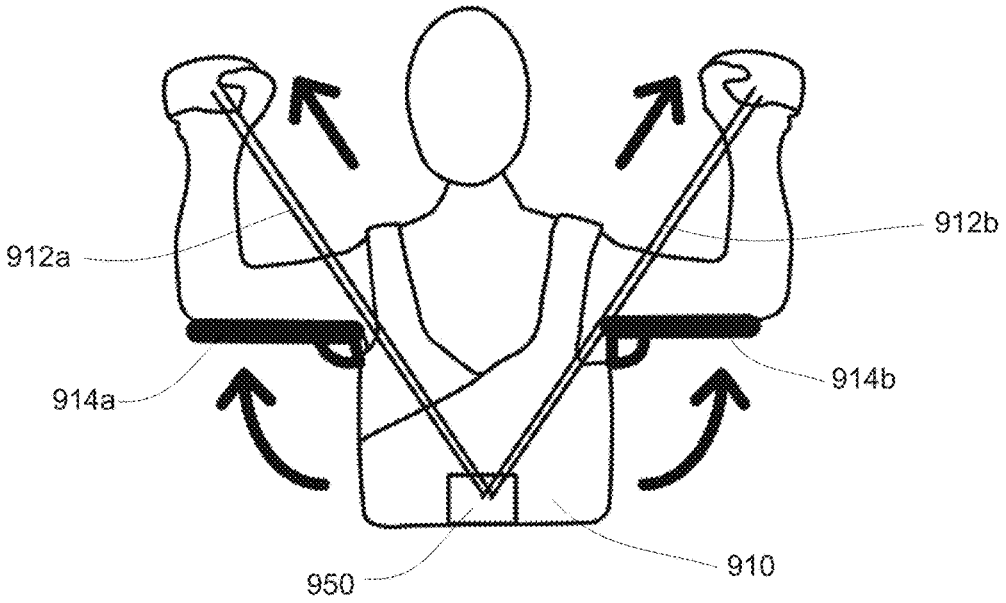
FIGS. 9*a*-9*c* show various views of a jacket in another embodiment.
Figure 9B:
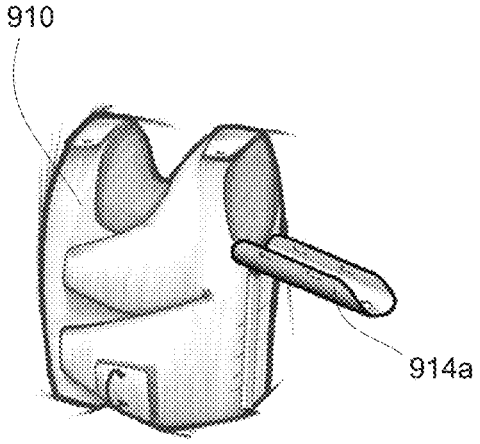
Figure 9C:
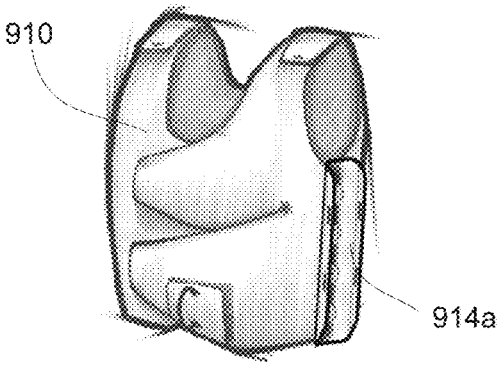

Looking at FIGS. 9*a*-9*c*, there is shown a portable exercise apparatus 900 comprising vest 910, resistance bands 912*a*, 912*b* and upper arm braces 914*a*, 914*b*, in operation by user 915.

Figure 10A:
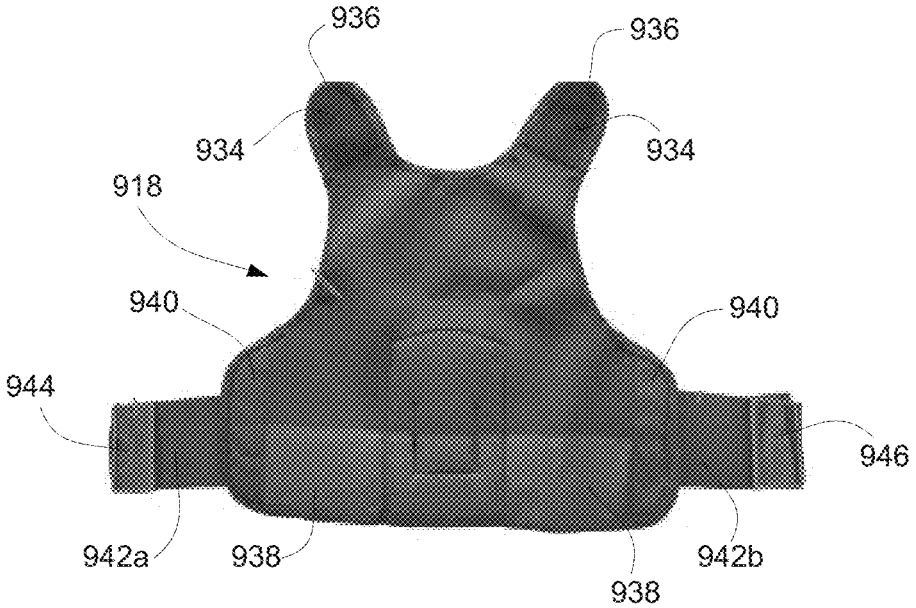
FIGS. 10*a* and 10*b* show a back-side view of the jacket of FIG. 9*a;*
Figure 10B:
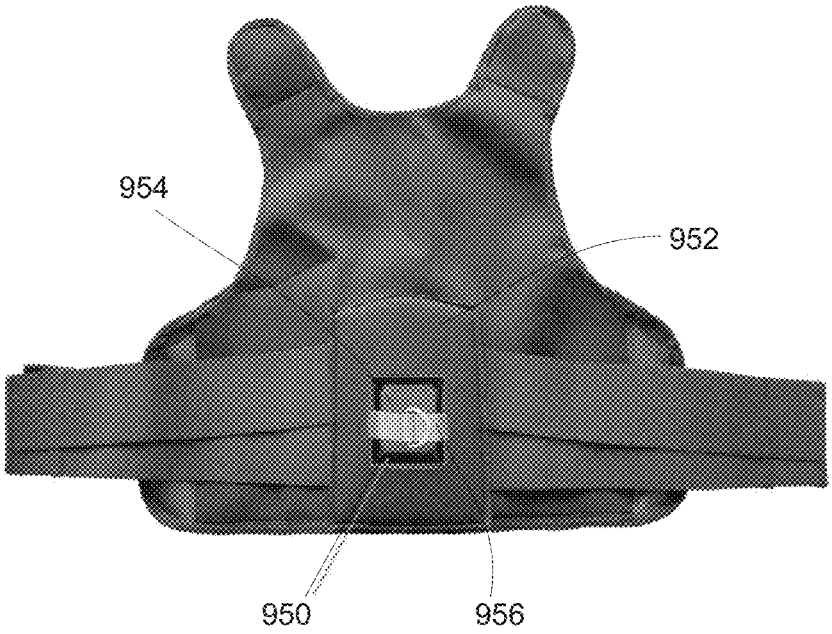
Figure 11A:
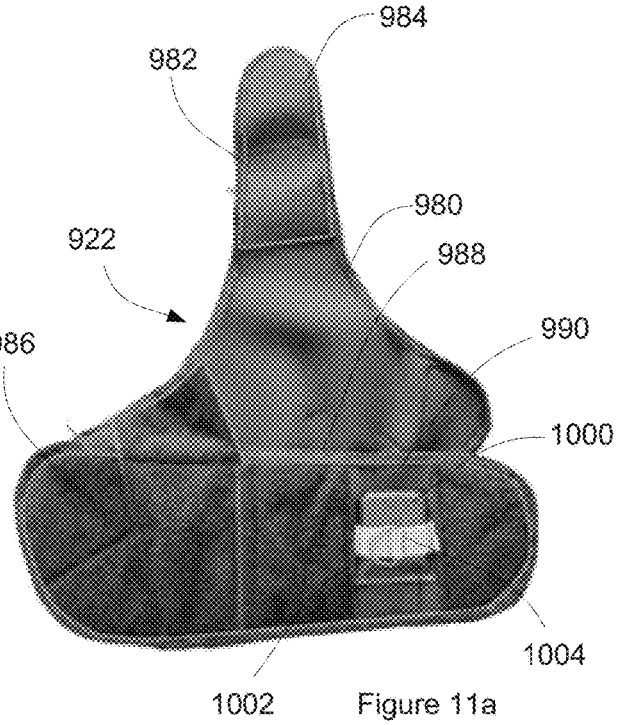
FIG. 11*a* shows an outer face of a right front vest panel of the jacket.
Figure 11B:
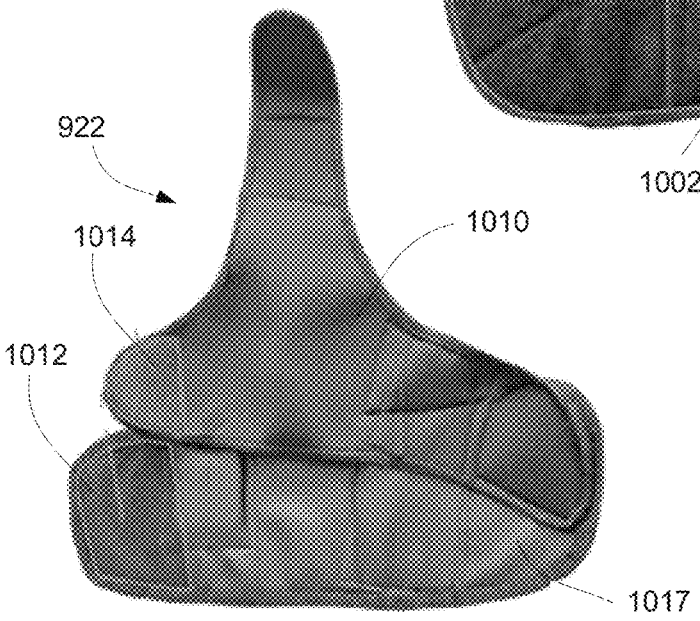
FIG. 11*b* shows inner face of the right vest panel of the jacket.
Figure 12A:
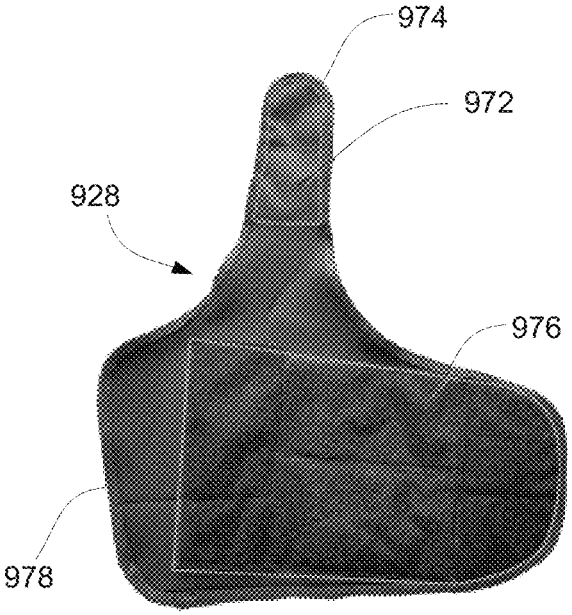
FIG. 12*a* shows an outer face of a left front vest panel of the jacket.
Figure 12B:
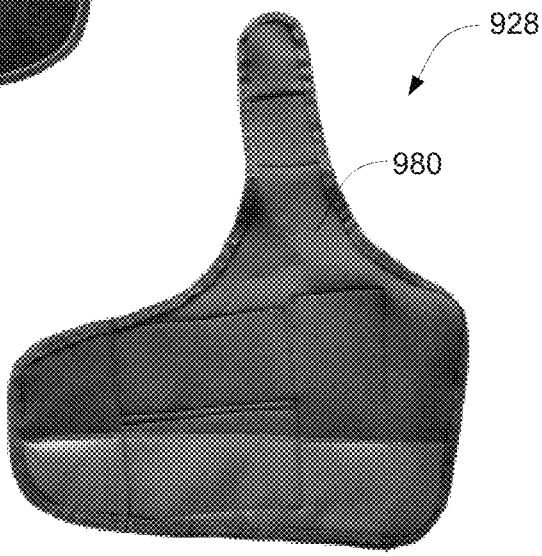
FIG. 12*b* shows an inner face of the left front vest panel of the jacket.

As can be seen in FIGS. 10*a*-*b*, vest 910 comprises rear vest panel 916 with inner face 918 and outer face 920; and right front vest panel 922 with inner face 924 and outer face 926, as shown in FIGS. 11*a*-*b*; and left vest panel 928 with inner face 930 and outer face 932, as shown in FIGS. 12*a*-*b*. Right front vest panel 922 and left vest panel 928 are removably attached to rear vest panel 916, and allow for adjustment for desired fit by a user. For example, rear vest panel 916, right front vest panel 922, and left vest panel 928 comprise an fastening means such as a hook and loop locking mechanism e.g. VELCRO.

In FIG. 10*a*, inner face 918 of rear vest panel 916 includes loop portion 934 secured to shoulder portions 936 of rear vest panel 916. Opposed torso portions 938 of rear vest panel 916 include hook portion 940 secured thereto. Attached to rear vest panel 916 are resistance bands 942*a, b* with terminating end of resistance band 942*a* having hook portion 944 secured thereto, while terminating end of resistance band 942*b* having loop portion 946 secured thereto.

In FIG. 10*c*, outer face 920 of rear vest panel 916 includes pocket 950 located about mid-torso portions 952, and dimensioned to accommodate exercise logging device 954 with electronic circuitry tracking and recording exercises performed by a user. Protuberance member 956*a*, 956*b* is moveably secured to exercise logging device 954 and receives one end of resistance bands 912*a*, 912*b*, respectively. As will be explained below, each protuberance member 956*a*, 956*b* is associated with sensing elements coupled to the electronic circuitry to detect forces applied to protuberance members 956*a*, 956*b* for the purpose of tracking and recording exercises performed by a user.

Back electronic logging device 954 is held within pocket 950 by strap 956. Resistance bands 942*a, b* are anchored to rear vest panel 918 on either side of pocket 950. As will be shown later, resistance bands 942*a, b* are stretched to secure front vest panels 922, 928 for a desired perfect fit by user. Accordingly, hook portion 944 of resistance band 942*a* and loop portion 946 of resistance band 942*b* meet and engage with each other. Rear vest panel 918 also comprises elongated pockets 960 on opposed sides of torso portion 938. These elongated pockets 960 are dimensioned to received and hold upper arm brace 914*a* in place.

FIG. 11*a* shows left front vest panel 928 with outer face 970 having hook portion 972 of a fastening means located on shoulder portion 974, and loop portion 976 located on abdominal portion 978. As can be seen in FIG. 11*a*, loop portion 976 covers the majority of the surface of outer face 970. FIG. 11*b* shows inner face 980 of left front vest panel 928.

FIG. 12*a* shows right front vest panel 922 with outer face 980 having hook portion 982 of a fastening means located on shoulder portion 984, and loop portion 986 located on abdominal portion 988. Loop portion 986 covers the majority of the surface of outer face 980, Abdominal portion 988 also includes pocket 990 dimensioned to receive front exercise logging device 1000 with protuberance members 1002 coupled thereto for attachment by resistance bands 912*a*, 912*b* (not shown). Front electronic logging device 1000 is held within pocket 990 by strap 1004. FIG. 12*b* shows inner face 1010 of right front vest panel 922 with hook portions 1012, 1014.

Figure 12C:
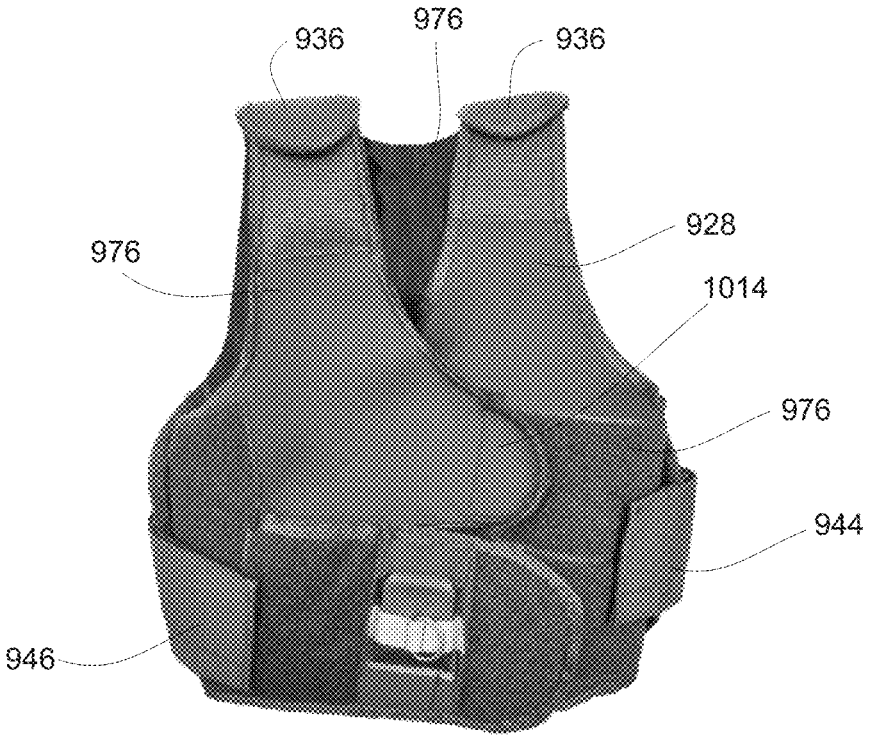
FIG. 12*c* shows a front view of the jacket.
Figure 13A:
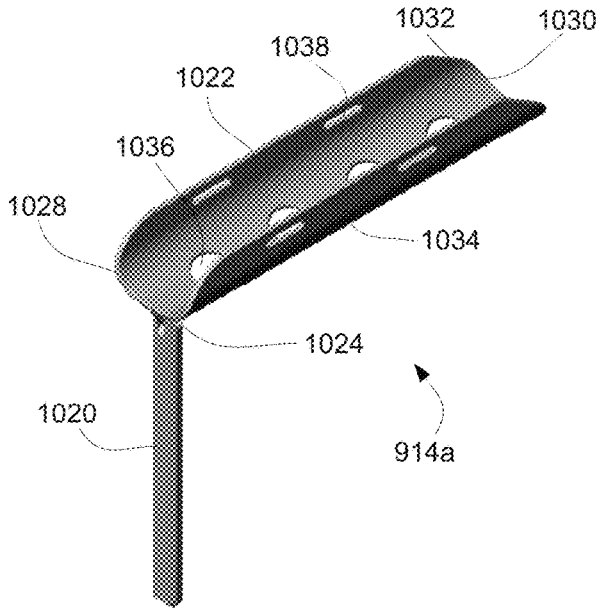
FIGS. 13*a*-13*d* show various views of an arm brace in an operating position.
Figure 13B:
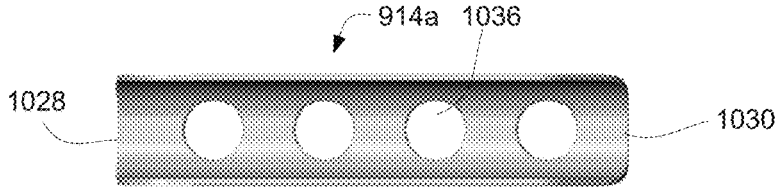
Figure 13C:
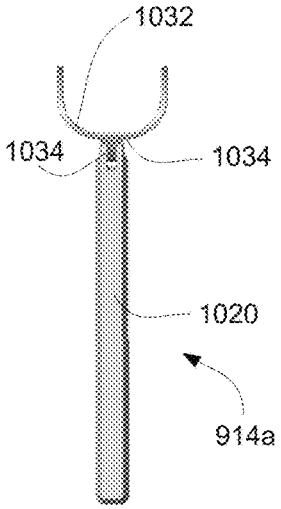
Figure 13D:
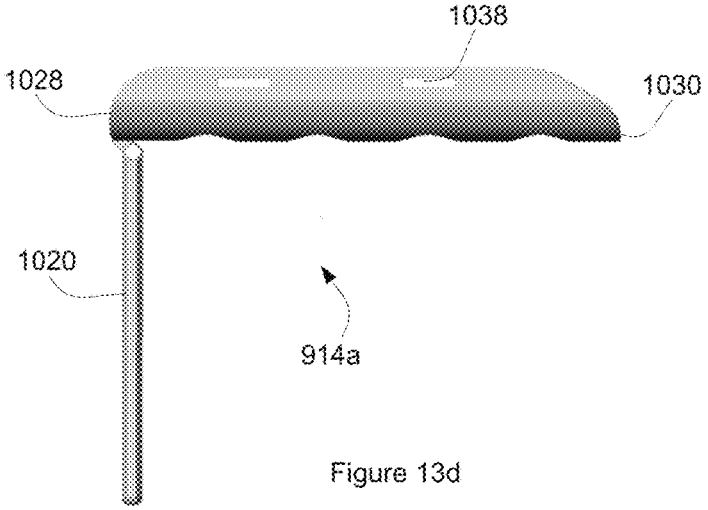
Figure 14A:
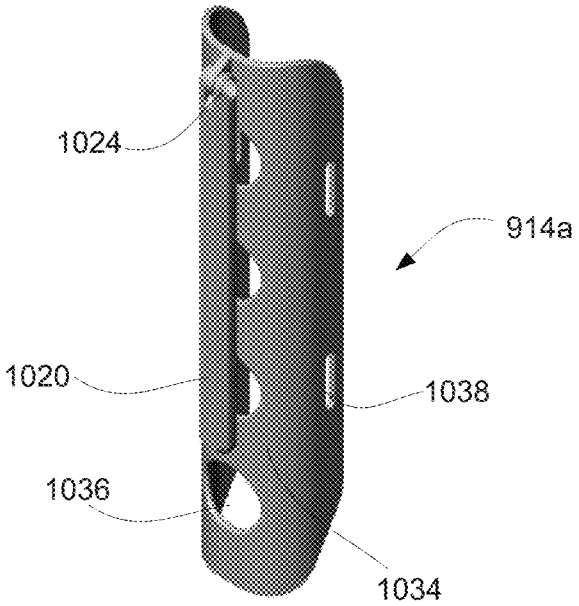
FIGS. 14*a*-14*d* show various views of the arm brace in a folded position.
Figure 14B:
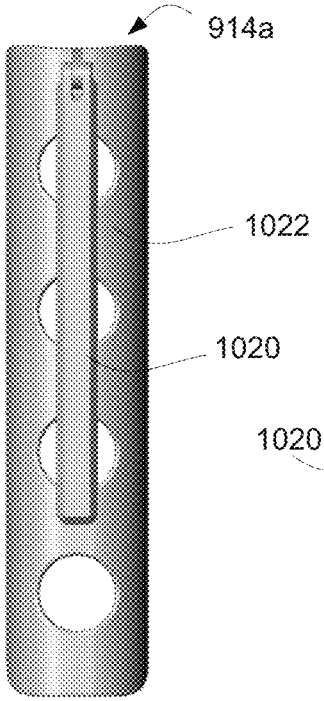
Figure 14C:
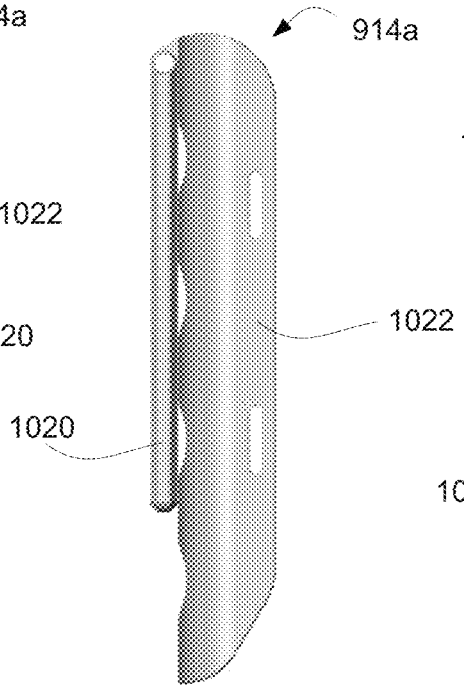
Figure 14D:
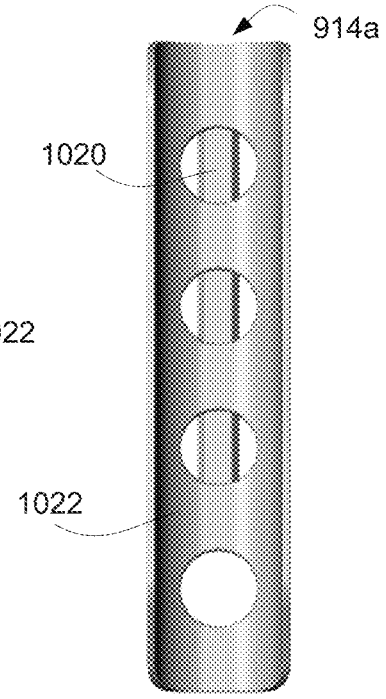
Figure 15B:
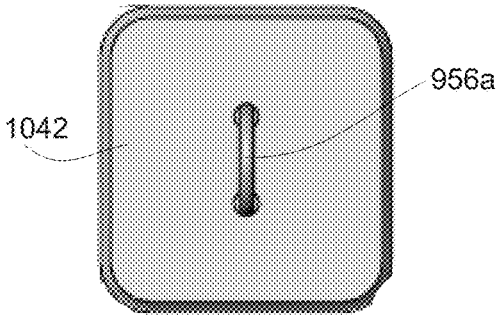
FIGS. 15*a*-15*d* show various views of an exercise logging device.
Figure 15A:
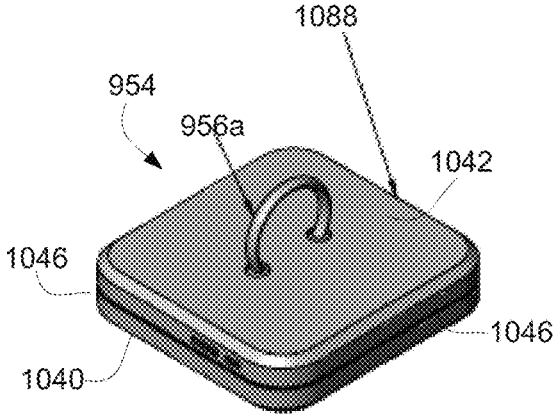
Figure 15C:
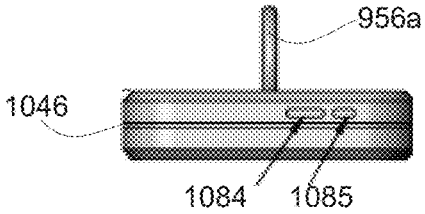
Figure 15D:
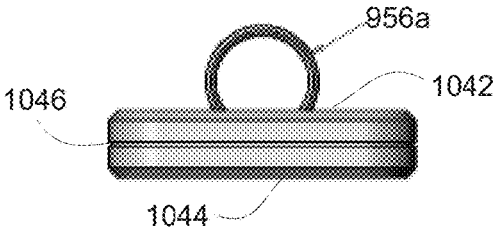

FIG. 12*c* shows vest 910 when fully assembled. Loop portions 934 at shoulder portions 936 of rear vest panel 918 engage hook portions 972, 982 at shoulder portions 974, 984 of left front vest panel 922 and right front vest panel 928, respectively. Hook portion 1014 of inner face 1010 of right front vest panel 922 engages loop portion 976 on outer face 970 of left front vest panel 928, and hook portion 1012 of inner face 1010 of right front vest panel 922 engages loop portion 976 on outer face 970 of left front vest panel 928. Resistance bands 942*a, b* (not shown) are stretched such that hook portions 946, 944 engage loop portion 986 located on abdominal portion 988 of right front vest panel 922 and loop portion 976 located on abdominal portion 978 of left front vest panel 928, to secure front vest panels 922, 928 for a desired perfect fit by user Now referring to FIG. 13*a* there is shown arm brace 914*a* having elongate pocket portion 1020 hingedly connected to arm portion 1022 via hinge 1024, in an operating position. Arm portion 1022 comprises convex-shaped longitudinal body 1026 having one end 1028 with hinge 1024 and open end 1030. Convex-shaped longitudinal body 1026 also comprises upper surface 1032 for receiving an arm of the user, and lower surface 1034, and a series of apertures 1036, 1038 extending from upper surface 1032 and lower surface 1034. In FIG. 14*a*, there is shown arm brace 914*a* in a folded position, with elongate pocket portion 1020 disposed parallel to arm portion 1022 and facing lower surface 1034 of convex-shaped longitudinal body 1026, Arm brace 914*a* is transformed from the folded position into the operating position by swinging elongate pocket portion 1020 away from arm portion 1022, or vice versa, until elongate pocket portion 1020 and arm portion 1022 are substantially perpendicular to each other and locking elongate pocket portion 1020 and arm portion 1022 in that position. Accordingly, upper surface 1032 of arm portion 1022 receives the arm of the user and supports the user's upper arm at substantially 90 degrees to the torso. Accordingly, the user is able to rest the upper arm thereon, while allowing the forearm to move as the user perform exercises with resistance bands 912*a*, 912*b*. FIGS. 13*b-d* show various views of arm brace 914*a* in the operating position, and FIGS. 14*b-d* show various views of the arm brace in the folded position.

Although vest 910 has been described as having multiple components, that is, rear vest panel 916, right front vest panel 922, and left vest panel 928, vest 910 may be formed of an unitary panel, that is adjustable for desired fit by a user.

Now looking at FIGS. 15*a-d* there is shown various views of front exercise logging device 954. Exercise logging device 954 comprises body 1040 with upper side 1042 and lower side 1044 and sidewalk 1046 therebetween. Body 1040 houses electronic circuitry 1050 for tracking and recording exercises performed by a user, and includes a sealing gasket 1041 to promote water impermeability into the interior of body 1040.

Figure 16:
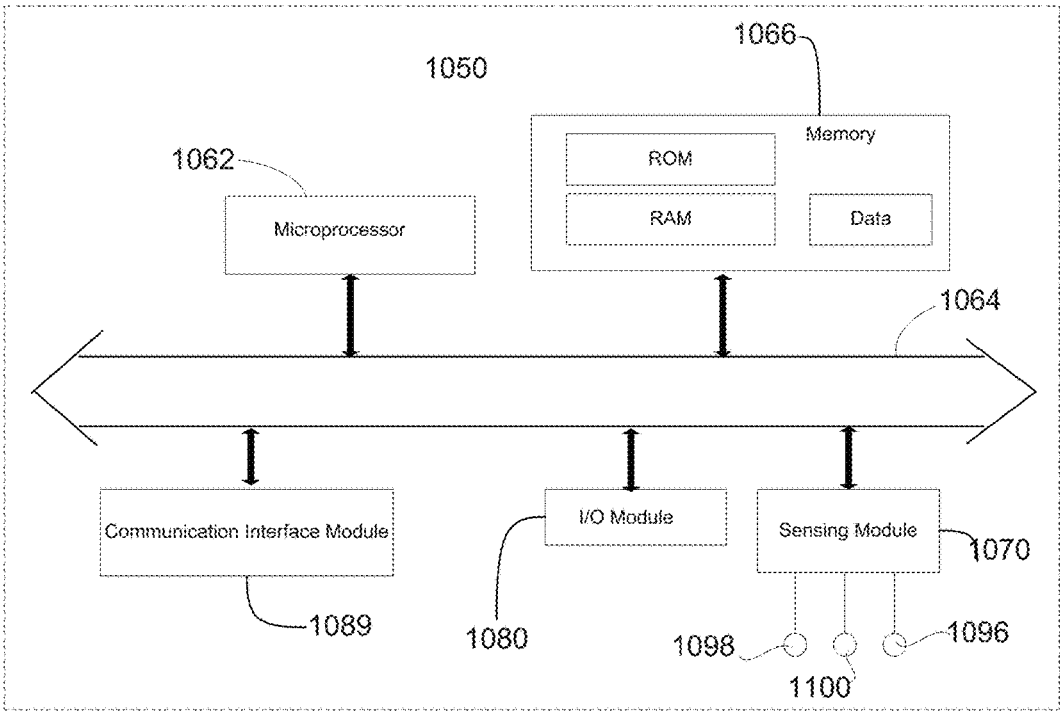
FIG. 16 shows electronic circuitry of an exemplary computing system.

As shown in FIG. 16, electronic circuitry on a printed circuit board 1050 comprising exemplary computing system or general-purpose computing device 1060 comprising processing unit (CPU or processor) 1062 and system bus 1064 that couples various system components including system memory 1066 such as read only memory (ROM) and random access memory (RAM) to processor 1062. Memory 1066 can include multiple different types of memory with different performance characteristics, such as a hard disk drive, a magnetic disk drive, a solid state drive, or the like. Processor 1062 can include any general purpose processor and a hardware module or software module, as well as a special-purpose processor where software instructions are incorporated into the actual processor design. The drives and the associated computer readable storage media provide non-volatile storage of computer readable instructions, data structures, program modules and other data for computing device 1060. In one aspect, a hardware module that performs a particular function includes the software component stored in a non-transitory computer-readable medium in connection with the necessary hardware components.

Electronic circuitry 1050 also includes sensing interface module 1070 to which sensing elements 1082 associated with protuberance member 956*a* are coupled. Electronic circuitry 1050 also includes I/O interface module 1080 to which sensing elements 1082 associated with protuberance member 956*a* are coupled, including multi-colour LED status indicator 1084 and power level LED indicator 1085 associated with power source 1086 e.g. battery and power management circuitry 1087. USB port 1088 coupled to power management circuitry 1087 allows recharging of battery 1086, or connection to user device 1090. Communications interface module 1089 is also included, and comprises a transceiver for emitting radio signals to transmit processed data to user device 1090. Generally, user device 1090 may be in the form of any kind of general processing structure, and may for example include any device, such as, a personal computer, laptop, computer server, handheld user device (e.g. personal digital assistant (PDA), mobile phone, tablet, smartphone.

Communications interface 1089 may include a USB interface, wired interface, wireless interface, optical, IR interface or RF interface, and may use standard protocols such as Wi-Fi (e.g. IEEE 802.11a/b/g/n, WiMax), Bluetooth, RFID, NFC, or other standard and non-standard physical layers well known to those skilled in the art. Accordingly, front exercise logging device 954 may include a unique identifier, such as a media access control (MAC) address, which is discovered or registered with user device 1090. For wireless communication, communication interface 1089 is associated with antenna 1094.

When resistance band 912*a* or 912*b* tugs on protuberance member 956*a*, sensing elements 1082 detect forces exerted on protuberance member 956*a* in one or more axes, such as x, y and z. Sensing elements 1082 may include torque meters, force sensors, and strain gauges 1096 which provide signals indicative of the detected force. Other sensors such as accelerometer or multi-axis accelerometer 1098 and gyroscope 1100 may be included. Accelerometer sensor 1098 measures the displacement of a mass with a position-measuring interface circuit. That measurement is then converted into a digital electrical signal through an analog-to-digital converter (ADC) for digital processing. Gyroscope 1100, however, measure both the displacement of the resonating s and its frame based on the Coriolis effect.

Electronic circuitry 1050 may include a signal conditioner for minimizing unwanted noise from the detected signals, an A/D converter for converting analog signals to digital signal data. Processor 1060 and/or an appropriate digital signal processor (DSP) associated therewith receives and processes the digital signal data by executing instructions stored in memory that may include statistical data analysis relating to force averages, force maximums, minimums, standard deviations, and calculation of moments and forces on protuberance member 956*a*. Additionally, other instructions may include various signal conditioning algorithms to eliminate unwanted vibration and noise signals using signal filters such as a first order Butterworth filters which preferably have a flat pass band and steep roll-off rate.

User device 1090 may include an application configured to provide a user-interface (UI) for requesting data related to the user exercises and displaying the requested data. For example, the data may include statistical data, graphical data, tracking data, calorific data, number of repetitions, exerted forces, frequency of repetitions, frequency of exercises, time of day of exercises, duration of repetitions, duration of exercises, exercising limb (right or left arm, right of left leg). The graphical data may include, but not be limited to, torque versus time, force versus time, force versus frequency, and torque versus frequency. The graphical data may also include power versus frequency plots. Furthermore, the graphical data may distinctly illustrate transient forces and frequencies of each individual axis independent of the other axes.

Figure 17:
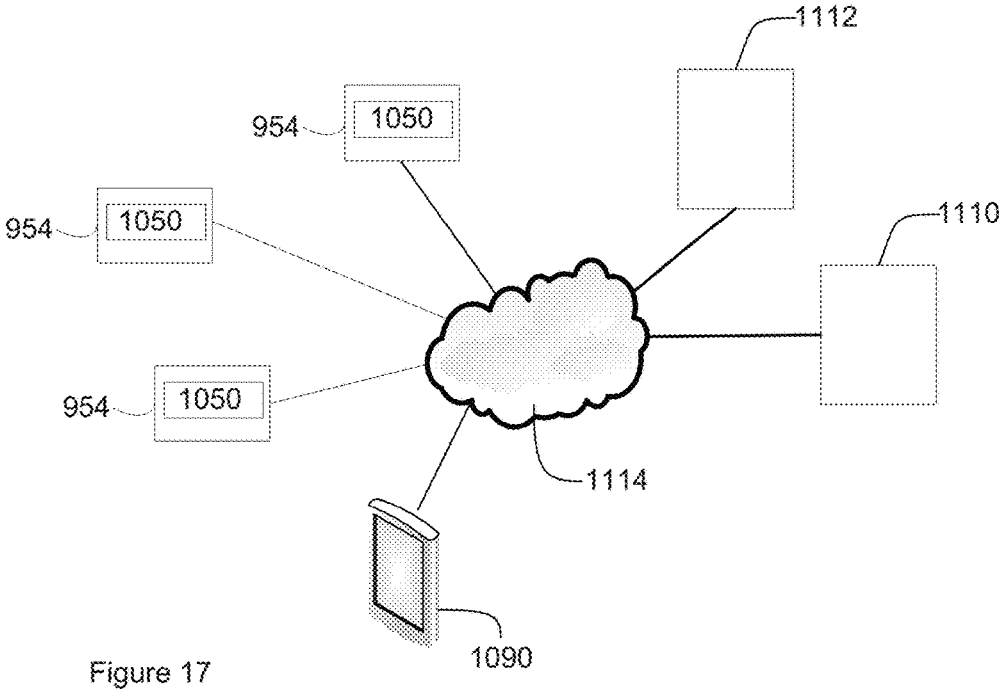
FIG. 17 shows an exemplary working environment for tracking exercises.

As shown in FIG. 17, the data may also be transmitted to a user device 1090, remote server 1110 or third party 1112 such as a healthcare professional, parent or guardian, or insurance provider via communication medium 1114. The data may be used to track a user's exercise regimen and progress, and allows for modification of the exercise regimen based on the reported progress.

In another implementation, the user can follow recommended exercises for particular injuries, muscle strengthening, physiotherapy via the suitable application on user device 1090. For example, a library of exercises may be stored in a database, and accessible by the user for guidance, or recommendation by a third party.

In another implementation, only one arm brace is employed.

In another implementation, only one electronic monitoring device is employed.

In another implementation, the jacket comprises a unitary body.

In another implementation, at least one protuberance member may be disposed on any suitable portion of the jacket to allow for exercising a particular limb, a particular muscle, or a variety of muscle groups, and including various orientations.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises," "comprising," or any other variations thereof; are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. For example, the steps recited in any of the method or process claims may be executed in any order and are not limited to the order presented. Thus, the preceding detailed description is presented for purposes of illustration only and not of limitation, and the scope of the invention is defined by the preceding description, and with respect to the attached claims.

The invention claimed is:

1. A light-weight, portable upper body exercise apparatus comprising:

a jacket member comprising a front portion and a back portion;

at least one protuberance member disposed on at least one of the front portion and the back portion;

at least one resistance cable having one end removably attached to the at least one protuberance member via the aperture and another end having a grip handle member; and at least one arm brace removably attached to the jacket member; and wherein the at least one arm brace comprises an elongate pocket portion connected to an arm portion.

2. The exercise apparatus of claim 1, wherein the arm portion is lockable in at least one position relative to the elongate pocket portion such that the arm portion receives an upper arm of a user in an operating position, while allowing a forearm of the user to move as the user perform exercises with the at least one resistance band.

3. The exercise apparatus of claim 2, wherein the jacket further comprises at least one exercise logging device comprising electronic circuitry for detecting forces exerted on the at least one protuberance member.

4. The exercise apparatus of claim 3, wherein the electronic circuitry comprises at least one sensing element comprising at least one of a torque meter, force sensor, and a strain gauge.

5. The exercise apparatus of claim 4, wherein the sensing elements comprise at least one of an accelerometer and a gyroscope.

6. The exercise apparatus of claim 5, wherein the at least one exercise logging device comprises electronic circuitry for logging at least one of a number of repetitions, exerted forces, frequency of the repetitions, frequency of exercises, time of day of exercises, duration of repetitions, duration of exercises, exercising limb (right or left arm, right of left leg).

7. The exercise apparatus of claim 6, wherein the at least one exercise logging device comprises electronic circuitry for storing data associated with the logging.

8. The exercise apparatus of claim 7, wherein the electronic circuitry comprises a transmitter for transmitting the data to a computing device.

9. The exercise apparatus of claim 8, wherein the computing device comprises a processor, a computer readable medium comprising instructions executable by the processor at least to:

track the user's exercise regimen and progress;

generate a report associated with user's exercise regimen and progress.

10. The exercise apparatus of claim 9, further comprising instructions executable by the processor at least to:

transmit the report to at least another computing device associated with at least one of the user and a third party; and allow for modification of the exercise regimen based on the reported progress.

11. An exercise apparatus comprising:

a jacket member comprising a front portion and a back portion;

at least one exercise logging device comprising at least one protuberance member with an aperture; the at least one protuberance member disposed on at least one of the front portion and the back portion;

at least one resistance cable having one end removably attached to the at least one protuberance member via the aperture and another end having a grip handle member;

sensing elements associated with electronic circuitry for detecting forces applied to the at least one protuberance member by the at least one resistance cable.

12. The exercise apparatus of claim 11, wherein the sensing elements detect forces exerted at least one protuberance member in at least one axis.

13. The exercise apparatus of claim 12, wherein the sensing elements comprise at least one of a torque meter, force sensor, and a strain gauge.

14. The exercise apparatus of claim 13, wherein the sensing elements comprise at least one of an accelerometer and a gyroscope.

15. The exercise apparatus of claim 14, further comprising at least one arm brace removably attached to the jacket member.

16. The exercise apparatus of claim 3, wherein the at least one arm brace comprises an elongate pocket portion hingedly connected to an arm portion, wherein the arm portion is lockable in at least one position relative to the elongate pocket portion such that the arm portion receives an upper arm of a user in an operating position, while allowing a forearm of the user to move as the user perform exercises with the at least one resistance band.

17. A method for tracking exercises, the method comprising:

providing an exercise apparatus comprising:

a jacket member comprising a front portion and a back portion;

at least one exercise logging device comprising at least one protuberance member with an aperture; the at least one protuberance member disposed on at least one of the front portion and the back portion;

at least one resistance cable having one end removably attached to the at least one protuberance member via the aperture and another end having a grip handle member;

sensing elements associated with electronic circuitry for detecting forces applied to the at least one protuberance member by the at least one resistance cable;

providing a computer readable medium for storing data pertaining to the detected forces;

providing a processor, the computer readable medium further comprising instructions executable by the processor at least to:

track the exercises;

determine adherence to a predetermined exercise regimen;

generate a report associated with the exercises and predetermined exercise regimen.

18. The method of claim 17, wherein the data is transmitted to a computing device comprising the processor and the computer readable medium.

19. The method of claim 18, further comprising instructions executable by the processor at least to:

transmit the report to at least another computing device associated with at least one of the user and a third party; and allow for modification of the exercise regimen based on the reported progress.

20. The exercise apparatus of claim 17, wherein the jacket member further comprises at least one arm brace removably attached thereto.

* * * * *